US007484257B2

(12) United States Patent
Schneider et al.

(10) Patent No.: US 7,484,257 B2
(45) Date of Patent: Feb. 3, 2009

(54) ELECTROMECHANICAL FURNITURE DRIVE MECHANISM

(75) Inventors: Johannes Schneider, Kirchlengern (DE); Rolf Farmont, Dusseldorf (DE)

(73) Assignee: Cimosys AG, Zürich (CH)

( * ) Notice: Subject to any disclaimer, the term of this patent is extended or adjusted under 35 U.S.C. 154(b) by 0 days.

(21) Appl. No.: 11/030,949

(22) Filed: Jan. 10, 2005

(65) Prior Publication Data

US 2005/0120481 A1 Jun. 9, 2005

Related U.S. Application Data

(63) Continuation of application No. PCT/EP2003/006548, filed on Jun. 20, 2003.

(30) Foreign Application Priority Data

Jul. 10, 2002 (DE) ..... 102 31 290

(51) Int. Cl.
*A61G 7/00* (2006.01)

(52) U.S. Cl. ..... 5/716; 5/613; 5/618

(58) Field of Classification Search ..... 5/613, 5/616–619

See application file for complete search history.

(56) References Cited

U.S. PATENT DOCUMENTS

| | | | |
|---|---|---|---|
| 2,790,485 | A | 4/1957 | Franklin |
| 3,051,965 | A | 9/1962 | Szemplak et al. |
| 3,300,794 | A | 1/1967 | Altorfer |
| 3,447,170 | A | 6/1969 | Spitz |
| 3,717,376 | A | 2/1973 | Lutchansky |
| 3,868,103 | A | 2/1975 | Pageot et al. |
| 4,258,445 | A | 3/1981 | Zur |
| 4,336,621 | A | 6/1982 | Schwartz |
| 4,349,924 | A | 9/1982 | Zur |
| 4,381,571 | A | 5/1983 | Elliott |
| 4,463,463 | A | 8/1984 | Kaneko |
| 4,559,656 | A | 12/1985 | Foster |

(Continued)

FOREIGN PATENT DOCUMENTS

| | | |
|---|---|---|
| CH | 607 682 | 10/1978 |

(Continued)

OTHER PUBLICATIONS

PCT Schriftlicher Bescheid Der Internationalen Recherchenbehorde (Regel 43 bis. 1PCT) dated Jun. 5, 2003 (5 pages).

(Continued)

*Primary Examiner*—Fredrick Conley
(74) *Attorney, Agent, or Firm*—Shlesinger, Arkwright & Garvey LLP

(57) ABSTRACT

Electromotive furniture drive for displacing parts of a piece of furniture relative to one another. The drive includes a drive element that can linearly move along a linear motion axis. This drive is provided for pivoting a pivotal element, which can pivot about a pivot axis and which, when the furniture drive is in a mounted position, is actively connected to a part of the piece of furniture to be displaced. An element may be provided that, during the displacing motion, maintains the engagement between the drive and the pivotal element at a point P that is essentially fixed along the linear motion axis. The furniture drive can be easily and economically produced and has a sturdy design.

23 Claims, 5 Drawing Sheets

U.S. PATENT DOCUMENTS

| | | | | |
|---|---|---|---|---|
| 4,589,151 | A | 5/1986 | Behrens | |
| 4,800,599 | A | 1/1989 | Korchinski et al. | |
| 4,928,332 | A | 5/1990 | Ogden et al. | |
| 5,063,623 | A | 11/1991 | Bathrick et al. | |
| 5,317,769 | A | 6/1994 | Weismiller et al. | |
| 5,490,298 | A | 2/1996 | Goldsmith et al. | |
| 5,491,854 | A | 2/1996 | Music | |
| 5,537,701 | A | 7/1996 | Elliott | |
| 5,542,744 | A | 8/1996 | Bathrick | |
| 5,544,376 | A | 8/1996 | Fromson | |
| 5,577,280 | A | 11/1996 | Elliott | |
| 5,640,730 | A | 6/1997 | Godette | |
| 5,675,849 | A | 10/1997 | Koch | |
| 5,687,437 | A | 11/1997 | Goldsmith | |
| 5,740,568 | A | 4/1998 | Elliott | |
| 5,829,077 | A | 11/1998 | Neige | |
| 5,870,784 | A | 2/1999 | Elliott | |
| 5,916,086 | A | 6/1999 | Rossdeutscher | |
| 5,926,872 | A | 7/1999 | Rossdeutscher | |
| 5,926,877 | A | 7/1999 | Lin | |
| 6,006,379 | A | 12/1999 | Hensley | |
| 6,061,852 | A | 5/2000 | Bathrick et al. | |
| 6,079,065 | A | 6/2000 | Luff et al. | |
| 6,088,853 | A | 7/2000 | Jansen et al. | |
| 6,101,647 | A | 8/2000 | Stroud et al. | |
| 6,105,187 | A | 8/2000 | Gnjatovic | |
| 6,209,157 | B1 | 4/2001 | Hensley | |
| 6,209,707 | B1 | 4/2001 | Ronchi | |
| 6,311,348 | B1 | 11/2001 | Luff | |
| 6,357,065 | B1 | 3/2002 | Adams | |
| 6,393,641 | B1 | 5/2002 | Hensley | |
| 6,679,555 | B2 | 1/2004 | Bangert | |
| 6,687,932 | B1 | 2/2004 | Bangert et al. | |
| 6,742,205 | B2 | 6/2004 | Dewert | |
| 6,754,922 | B2 * | 6/2004 | Dewert | 5/617 |
| 6,763,536 | B2 | 7/2004 | Dewert | |
| 2001/0000828 | A1 | 5/2001 | Hensley | |
| 2002/0152552 | A1 | 10/2002 | Dewert | |
| 2002/0162170 | A1 | 11/2002 | Dewert | |
| 2003/0052238 | A1 | 3/2003 | Schneider | |
| 2003/0079290 | A1 | 5/2003 | Dewert | |
| 2003/0106154 | A1 | 6/2003 | Takeuchi | |
| 2003/0208845 | A1 | 11/2003 | Heaton | |
| 2004/0034934 | A1 | 2/2004 | Weinman et al. | |

FOREIGN PATENT DOCUMENTS

| | | | |
|---|---|---|---|
| DE | 26 14 105 | A | 10/1976 |
| DE | 31 03922 | A1 | 8/1982 |
| DE | 32 182 78 | A1 | 11/1983 |
| DE | 32 16559 | A1 | 11/1983 |
| DE | 87 11 567 | U1 | 3/1988 |
| DE | 88 00 360 | U1 | 7/1988 |
| DE | 88 06 094.2 | | 8/1988 |
| DE | 38 42 978 | A1 | 7/1989 |
| DE | 91 10 121 | U | 11/1991 |
| DE | 38 42 078 | C2 | 7/1992 |
| DE | G 92 10 801.6 | | 12/1992 |
| DE | 93 11 520 | U1 | 6/1994 |
| DE | 195 00 185 | A1 | 7/1996 |
| DE | 195 03 650 | A1 | 8/1996 |
| DE | 195 43 321 | A1 | 5/1997 |
| DE | 297 01 084 | | 7/1997 |
| DE | 298 00 197 | U1 | 4/1998 |
| DE | 197 39 453 | A1 | 3/1999 |
| DE | 695 07 158 | T2 | 9/1999 |
| DE | 299 19 238 | U1 | 4/2000 |
| DE | 200 00 700 | U1 | 5/2000 |
| DE | 299 07 850 | U1 | 5/2000 |
| DE | 199 21 300 | A1 | 11/2000 |
| DE | 201 00 733 | U1 | 4/2001 |
| DE | 100 17 979 | A1 | 7/2001 |
| DE | 100 46 751 | A1 | 7/2001 |
| DE | 199 62 541 | A1 | 7/2001 |
| DE | 199 62 538 | A1 | 8/2001 |
| DE | 100 17 978 | C2 | 10/2001 |
| DE | 100 46 752 | | 3/2002 |
| DE | 100 46 750 | C1 | 4/2002 |
| DE | 203 02 139 | U1 | 5/2003 |
| DE | 199 62 541 | C3 | 11/2003 |
| EP | 0 373 912 | | 6/1990 |
| EP | 0 372 032 | B1 | 5/1992 |
| EP | 0 583 660 | A1 | 2/1994 |
| EP | 0 445 325 | B1 | 6/1994 |
| EP | 0 642 753 | A1 | 3/1995 |
| EP | 0 721 754 | | 7/1996 |
| EP | 0 778 016 | A2 | 6/1997 |
| EP | 0 873 709 | A1 | 10/1998 |
| EP | 0 884 011 | A1 | 12/1998 |
| EP | 0 788 325 | B1 | 1/1999 |
| EP | 0 935 937 | A1 | 8/1999 |
| EP | 1 152 167 | A2 | 11/2001 |
| EP | 0 372 032 | B2 | 3/2002 |
| FR | 761 361 | A | 3/1934 |
| FR | 2 780 256 | A1 | 12/1999 |
| GB | 2 081 083 | A | 2/1982 |
| IT | 0 568 957 | | 11/1993 |
| WO | 91/01099 | | 2/1991 |
| WO | 92/09520 | | 6/1992 |
| WO | 96/29970 | | 10/1996 |
| WO | 99/42021 | | 8/1999 |
| WO | 2004/062435 | A1 | 7/2004 |

OTHER PUBLICATIONS

International Search Report dated Oct. 19, 2004 in PCT/EP2004/005655, filed May 26, 2004 (2 pages).

Catalogue of the German firm Dewert Antriebs-und systemtechnik "Gesamtprogram 1995/96" pp. 12 & 13.

Catalogue of the German firm Dewert Antriebs-und Systemtechnik "Antriebe, Handschalter, Steuerungen, Beschlëge", No. 05/97 (excerpt 6 pages).

International Search Report dated Jul. 15, 1996 in International Application No. PCT/DK96/00119, filed Mar. 26, 1996 (3 pages).

PCT Schriftlicher Bescheid (Regel 66 PCT) dated Nov. 14, 2001 (6 pgs).

International Preliminary Examination Report (PCT) Article 36 & Rule (70), dated Apr. 30, 2002 for International Application No. PCT/EP00/13804 ( 4 pages).

International Search report for International Application No. PCT/EP00/13084 dated Jun. 16, 2001 (4 pages).

International Search Report dated Nov. 11, 2003 in International Application No. PCT/EP03/06548 filed Jun. 20, 2003 (3 pages).

International Search Report dated Jun. 06, 2001 in International Application No. PCT/EP03/13074 filed Dec. 21, 2000 ( 8 pages).

Certified English Translation [dated Jun. 17, 2008] of German Gebrauchsmuster No. G 93 18 082.9 filed Nov. 26, 1993, 12pp.

* cited by examiner

ELECTROMECHANICAL FURNITURE DRIVE MECHANISM

CROSS-REFERENCE TO RELATED APPLICATIONS

This application is a continuation of international application no. PCT/EP2003/006548, filed 20 Jun. 2003, which claims priority of German patent application no. 102 31 290.7, filed Jul. 10, 2002, and each of which is incorporated herein by reference.

FIELD OF THE INVENTION

This invention relates to a electromechanical furniture drive mechanism for moving sections of a piece of furniture relative to one another. More particularly the invention relates to a furniture drive mechanism configured for exerting substantially consistent adjustment forces during movement of sections of a piece of furniture relative to one another.

BACKGROUND OF THE INVENTION

Furniture drive mechanisms of that type have been widely known and are used for instance as adjustment drives for adjusting the parts of a lattice array relative to one another.

EP 0 372 032 B1 describes a furniture drive mechanism of the type referred to above, comprising a pivot-mounted, pivotable swivel unit which is functionally connected to a positionally adjustable part of the furniture via a drive unit that is linked to the furniture drive mechanism in its operating state and can be moved in an axial direction along a linear axis of travel. In that earlier furniture drive mechanism the axially movable drive unit includes the nut of a spindle drive while the swivel unit is a pivot lever that is rigidly connected to a pivot shaft which in turn is functionally connected to the adjustable section of the furniture item. The spindle drive nut is in freely moving contact with the end of the pivot lever facing away from the pivot shaft.

Similar furniture drive mechanisms have also been described in DE 38 42 078 C2, EP 0 583 660 B1, DE 100 46 750 C1 and DE 100 46 752 C1.

In these earlier furniture drive designs the adjustment movement is accompanied by a change in the angular position of the pivot lever relative to the linear axis of travel of the drive unit. The resulting drawback is that the effective length of the lever arm that engages in the pivot shaft, meaning the length of the lever-arm component that extends perpendicular to the linear axis of travel of the drive unit, keeps changing during the adjustment movement, which in turn causes the force that bears on the pivot shaft and thus on the adjustable part of the furniture item during the adjustment movement to change continuously and to diminish as the effective length of the lever arm decreases. As the angle between the linear axis of travel of the drive unit and the longitudinal axis of the pivot lever grows more acute, the adjustment force exerted by the furniture drive mechanism on the adjustable part of the furniture item decreases at a correspondingly steep rate. A particular disadvantage lies in the fact that the angle grows more acute as the furniture drive mechanism approaches the end position of its adjustment movement even though that is where the force of the furniture acting on the drive mechanism, and thus the necessary adjustment force, is usually the highest.

DE 100 17 978 A1 and DE 100 17 979 A1 each describe similar furniture drive mechanisms in which, however, the drive unit is in the form of a flexible tension element such as a pull strip.

It is an object of this invention to introduce a furniture drive mechanism configured for displacing parts of a piece of furniture relative to each other, and in which the stated drawback of the conventional furniture drive mechanisms is eliminated by substantially avoiding any decrease of the adjustment force provided by the furniture drive mechanism during the adjustment movement, yet which can be produced by a simple process and thus at low cost.

This object is achieved by an electromechanical furniture drive configured during an adjustment movement, for adjusting sections of a piece of furniture relative to one another, comprising a drive unit, the drive unit being axially movable along a linear axis of travel for tilting a swivel unit, which in an operational position of the furniture drive mechanism is functionally connected to an adjustable section of the piece of furniture and can be rotated around a swivel axis, and the drive unit including an element configured for causing the drive unit to remain engaged in the swivel unit at substantially fixed point P along a linear axis of travel (30) throughout the adjustment movement.

The invention is based on the realization that the effective length of the swivel-unit lever arm changes because during the adjustment movement the point at which the drive unit engages in the swivel unit keeps shifting along the linear axis of travel of the drive unit. Accordingly, the invention is based on a concept whereby an element is provided that keep the drive unit engaged in the swivel unit at an substantially fixed point along the linear axis of travel. In that fashion, the effective length of the lever arm remains substantially unchanged during the adjustment movement and, consequently, the adjustment force exertable on the adjustable section of the furniture item by the furniture drive mechanism will remain substantially constant throughout the adjustment movement. It follows that, throughout that adjustment movement, forces of an substantially uniform order of magnitude are applied on the adjustable part of the furniture item, and most significantly in the end positions of the adjustment movement as well.

The furniture drive mechanism according to this invention is of a simple design, consequently inexpensive to produce, and rugged. It lends itself well to the adjustment of any given sections of a piece of furniture but especially to the adjustment of movable parts of a support system such as supports the slats of a lattice supporting the cushions of a chair and/or chaise lounge.

To keep the drive unit engaged in the swivel unit at an substantially fixed point along the linear axis of travel throughout the adjustment movement, the swivel unit, or a component attached to the swivel unit, is provided in the direction of rotation with an extension which is so configured that during the adjustment movement the drive unit remains constantly engaged in the swivel unit at an substantially fixed point. To that effect, the swivel unit may be provided for instance with several lever arms consecutively positioned in the direction of rotation and sequentially engaging the drive unit in such fashion that over the course of the adjustment movement the drive unit remains engaged in the swivel unit at an substantially fixed point along the linear axis of travel. In an implementation of the inventive concept that is particularly simple and thus manufacturable at low cost, the element or provisions that keep the drive unit engaged in the swivel unit during the adjustment movement at an substantially fixed point along the linear axis of travel encompass a cam-shaped guide element for the drive unit which guide element is linked to the furniture drive mechanism in its operating position. Cams of that type are particularly simple in design and correspondingly inexpensive to make, meaning that the overall furniture drive mechanism according to the invention is particularly uncomplicated and can be produced at low cost.

In another embodiment of the invention, the guide element has an substantially circular-arc profile. The guide element in that configuration is particularly simple and thus inexpensive to make.

In the aforementioned embodiment, the guide element can extend over an angle of 360°, or approximately 360°, relative to the swivel axis, with the guide element substantially having a fully circular profile. In another embodiment, of the invention, the guide element substantially constitutes the segment of a circle and, in particular, a quarter circle. For the guide element, this much of an extension in the direction of rotation is usually sufficient to ensure the engagement of the drive unit in the swivel element during the adjustment movement at an substantially fixed point along the linear axis of travel.

In another embodiment employing a guide element configured as a cam, the guide element has an substantially curved profile whereby, in the circumferential direction of the guide element, at least certain sections vary in their distance between the periphery of the profile and the swivel axis. In this embodiment the guide element and the drive unit jointly constitute a cam drive mechanism. As the curvature of the guide element changes in during constant speed of the drive unit along the linear axis of travel, the angular at which the swivel unit is rotated will change correspondingly.

Depending on individual requirements, the drive unit may be a traction or a pressure element as provided for in other embodiments.

In other embodiments of the invention, the drive unit may be flexible or substantially rigid.

In an extraordinarily advantageous embodiment according to this invention, the drive unit that engages in the guide element in the operating position of the furniture drive mechanism is provided with a toothed surface that substantially meshes with a corresponding toothed surface of the guide element. Configured that way, the guide element and the drive unit interact like a gear system. This embodiment is particularly simple and thus inexpensive to make. Moreover, it is especially sturdy and permits the application of considerable force.

In this embodiment the guide element may be in the form of a gear wheel or of a toothed quadrant as provided for in another embodiment. Gear wheels are commercially available as simple and therefore inexpensive standard products, which further simplifies the design of the furniture drive mechanism according to the invention.

In another embodiment of the above-described concept, the drive unit encompasses a chain, the combination constituting a chain drive. This embodiment as well is particularly simple and thus inexpensive to make and permits the application of considerable force.

In another embodiment of the inventive concept employing a guide element in the form of a gear wheel or toothed quadrant, the drive unit may include a toothed rack, the combination forming a rack-and-pinion drive mechanism. This configuration is again particularly uncomplicated, correspondingly inexpensive to make, and especially rugged.

In another embodiment the drive unit encompasses a rope or belt that works with the guide element, in the form of a rope drum or belt pulley, the combination constituting a belt drive mechanism. This embodiment further simplifies the design of the novel furniture drive mechanism.

The guide element may be a separate component rigidly connected to the swivel unit. However, the configuration of the furniture drive mechanism according to the invention can be further simplified by producing the guide element and the swivel unit in the form of one integral component, or with the swivel unit doubling as the guide element, as provided for in another embodiment of the invention.

The axially moving drive unit may be of any suitable design. In a desirable implementation of the inventive concept the axially moving drive unit connects to, or is constituted of, a linearly movable drive element of a spindle drive mechanism. Spindle drives of that kind are commercially available as simple, low-cost standard components, they lend themselves well to the transfer of strong forces, and they are sturdy.

The axially movable drive element of the aforementioned spindle drive mechanism may be a spindle nut which is torsionally locked but axially movable on a rotating drive spindle.

In a kinematically reversed implementation of this embodiment, the axially movable drive element of the spindle drive mechanism may equally well be an axially movable but torsionally locked spindle on which a stationary, rotationally drivable spindle nut is mounted.

In another advantageous embodiment of the inventive concept, the drive unit is attached to the swivel unit or to the guide element.

An electromechanical adjustable support system for the cushions of a chair and/or lounger and especially for the mattress of a bed are provided. Variations and further embodiments of the support system are described herein.

An inventive adjustment assembly for relatively adjustable parts of a piece of furniture is provided, as set forth herein. Appropriate, advantageous embodiments of the invention are described herein that are particularly suited for different applications and types of furniture.

Relative terms such as up, down, left, and right are for convenience only and are not intended to be limiting.

BRIEF DESCRIPTION OF THE DRAWINGS

The following will explain this invention in more detail based on embodiment illustrated in the attached drawings in which.

DETAILED DESCRIPTION OF THE INVENTION

Figure 1:
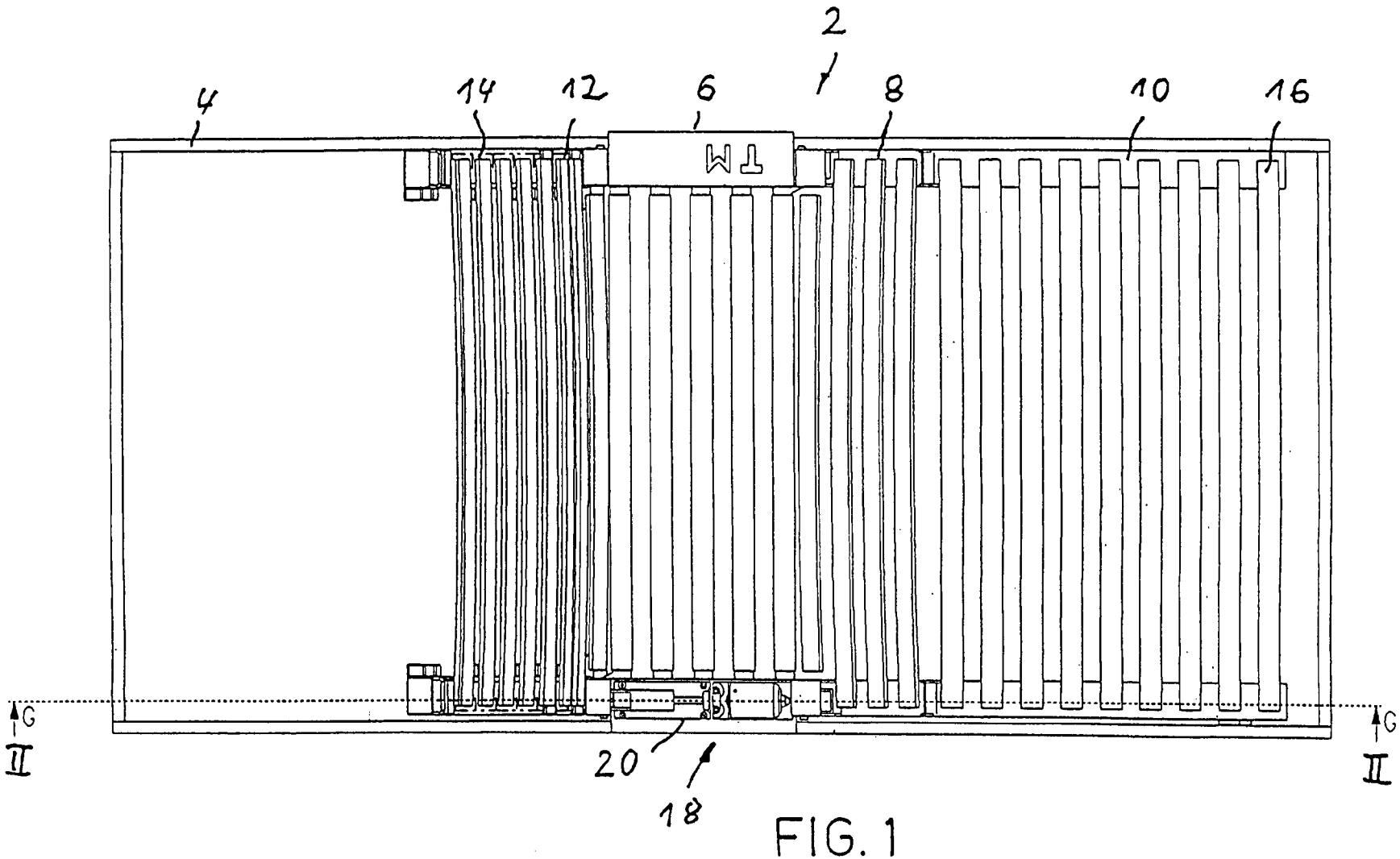
FIG. 1 is a top view of a support system according to this invention, implemented in a slat array and equipped with embodiment of a furniture drive mechanism according to the invention.

In the drawings and description, identical or comparable components bear identical reference numbers.

FIG. 1 depicts an embodiment of a support device or system 2 according to the invention, which in the case of this embodiment includes a slat system with a frame or base body 4 to which connects a stationary center support part or section 6. The center support part or section 6 connects in hinged fashion to a leg support part or section 8 which can be tilted around a horizontal swivel axis and which, at its far end away from the center support section 6, connects in hinged fashion to a lower leg support part or section 10 that can be tilted around a horizontal swivel axis. The end of the center support section 6 facing away from the leg support section 8 connects in hinged fashion to a torso or upper body support section 12 that can be tilted around a horizontal swivel axis and, at its end facing away from the center support section 6, connects in hinged fashion to a head support section 14 that can be tilted around a horizontal swivel axis. The interconnection between the support sections 6 to 14 may be conventional and therefore need not be discussed here in detail.

On their top side the support sections 6 to 14 are provided with resilient slats only one of which is identified in the drawing by reference number 16. These slats 16 provide resilient support, by the support system 2, of the cushions, not illustrated, of a chair and/or lounger and/or chaise lounge or for instance of the mattress of a bed.

The inventive support system 2 is equipped with a first embodiment of a furniture drive mechanism 18 according to the invention, which, in the case of this embodiment, serves to adjust the torso support section 12 and the head support section 14 relative to the center support section 6. In this embodiment example the furniture drive mechanism 18 is accommodated in a hollow lateral rail or beam 19 of the center support section 6.

Figure 2:
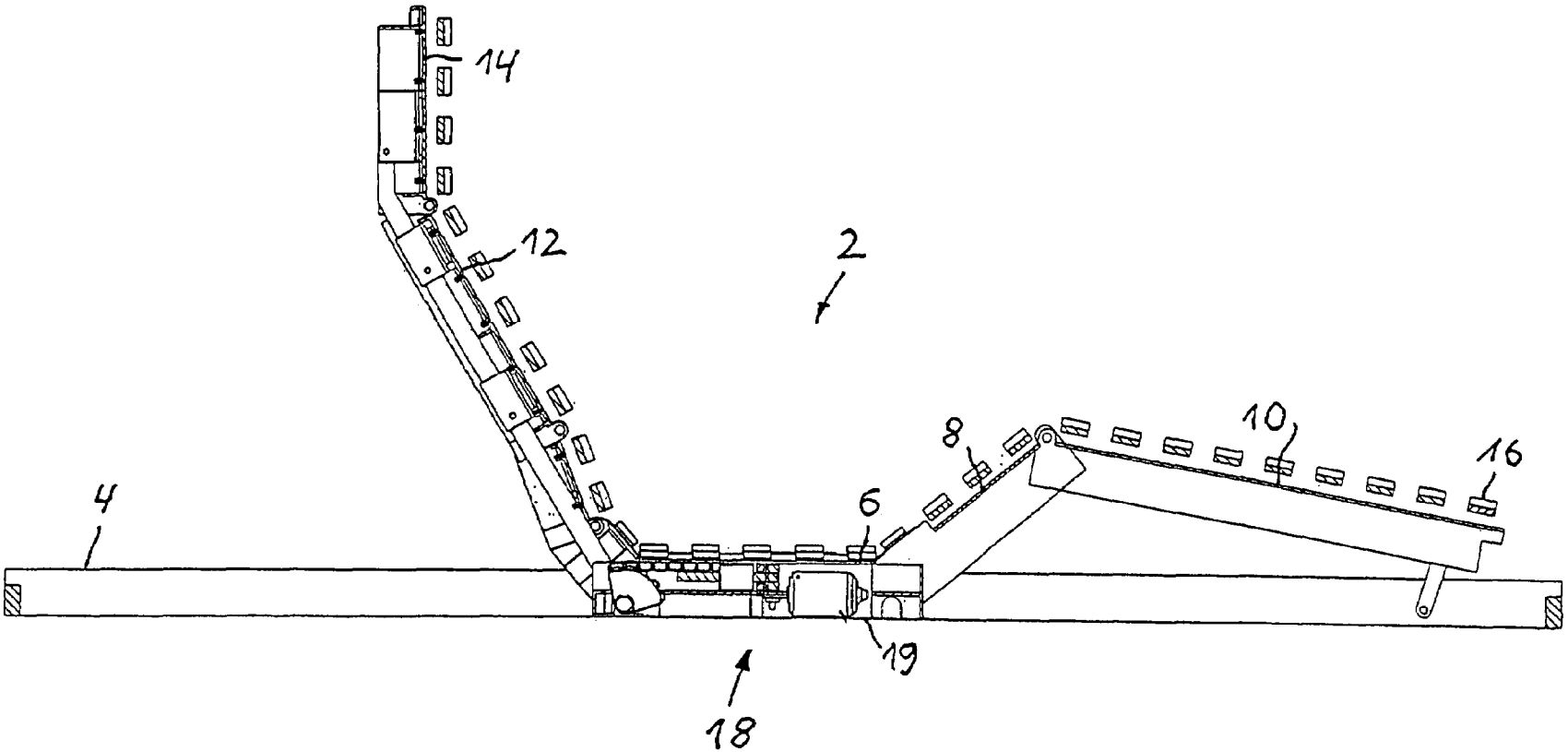
FIG. 2 is a sectional view along the line II-II in FIG. 1.

FIG. 2 is a sectional view along the line II-II in FIG. 1

Figure 3:
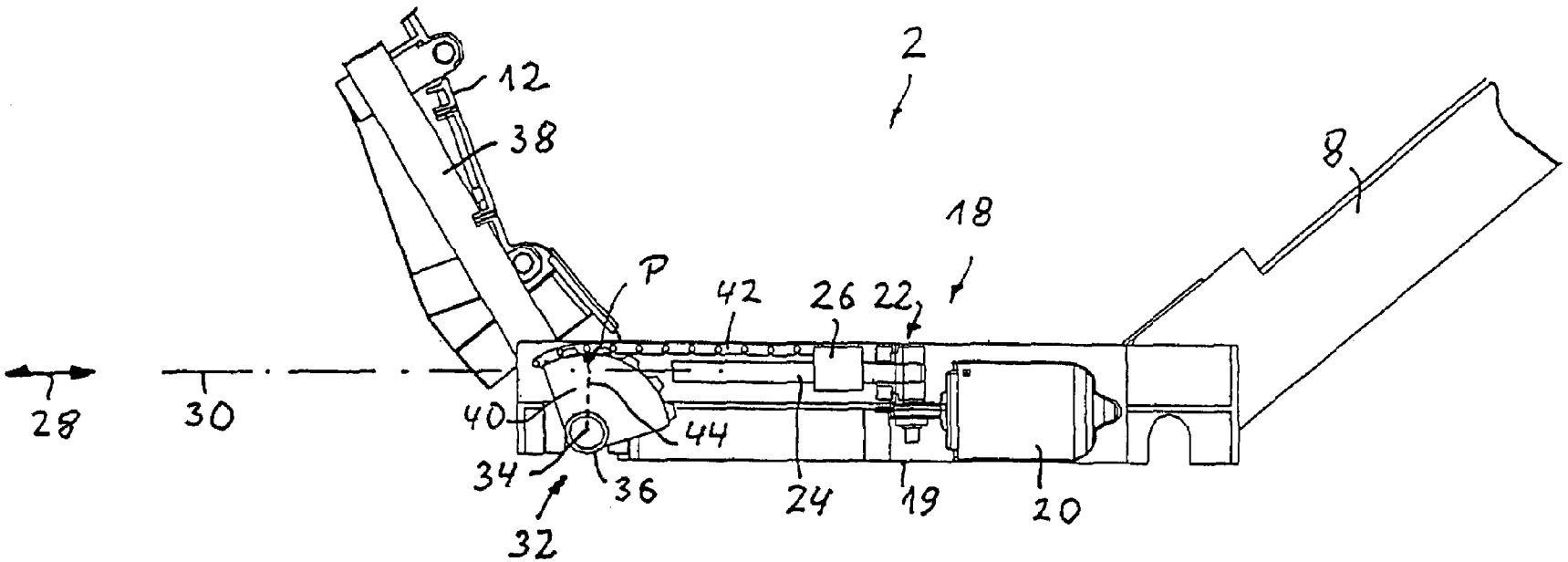
FIG. 3 along the same view as in FIG. 2, depicts an enlarged-scale detail of FIG. 2 in the area of the furniture drive mechanism.

FIG. 3 shows the inventive furniture drive mechanism 18 per FIG. 2 on an enlarged scale. The furniture drive mechanism 18 encompasses an electric motor 20 that is mounted on a wall of the lateral rail 19 and, via a gear transmission 22, connects to and rotationally drives a fixed, screw-type drivable spindle 24 of a spindle drive mechanism. A spindle nut 26 positioned on the spindle is rotationally locked while capable of moving back and forth in the direction of a double-headed arrow 28. As a function of the direction of rotation of the drive shaft of the electric motor 20, and thus of the direction of rotation of the spindle 24, the spindle nut 26 moves along a linear axis of travel 30 in FIG. 3, to the left or to the right.

The support system 2 in this embodiment features an inventive adjustment assembly 32 which in the case of this embodiment encompasses a pivot shaft 36 that can rotate around a swivel axis 34, that is mounted on the frame 4 of the support system 2 and is rigidly connected to a pivot lever 38. The pivot lever 38 connects to the torso support section 12 and to the head support section 14 in such fashion that a rotation of the pivot shaft 36 around the swivel axis 34 causes the torso support section 12 and the head support section 14 to change position. The adjustment assembly 32 according to this invention includes a swivel unit that is rigidly connected to the pivot shaft 36 and in the case of this embodiment is in the form of a gear-wheel segment 40 that meshes with a flexible traction element in the form of a chain 42 one end of which is attached to the gear-wheel segment 40 while its other end is attached to the spindle nut 26. In this embodiment the chain 42 serves as the drive unit of the furniture drive mechanism 18 that is movable along the linear axis of travel 30.

According to the invention, provisions are incorporated that keep the drive unit in the embodiment per FIG. 1, i.e. the chain 42, engaged in the swivel unit, here the gear-wheel segment 40, at a substantially fixed point P along the linear axis of travel 30 throughout the adjustment movement. In the embodiment per FIG. 1, these provisions consist of a design whereby the gear-wheel segment 40 is in the form of a cam serving as the guide element for the chain 42. In this embodiment the gear-wheel segment 40 substantially has a limited circular-arc i.e. quarter-circle profile. During the adjustment movement the gear-wheel segment 40 pivots around the swivel axis 34, which changes the wrap angle of the chain 42 around the gear-wheel segment 40. But the chain 42 remains constantly engaged in the gear-wheel or gear segment 40 at a substantially fixed point P along the linear axis of travel 30, which in turn leaves the effective length of the lever arm, symbolized in FIG. 3 by a dashed line 44, through which the chain 42 engages in the pivot shaft 36, substantially unchanged during the adjustment movement. The circumference of cam gear wheel segment 40 in the form of a cam tangentially engages the linearly moving drive unit at substantially fixed point P along linear axis of travel 30 throughout the adjustment movement.

The functional operating mode of the inventive furniture drive mechanism 18 is as follows:

To move the torso support section 12 and the head support section 14 from an adjustment-movement starting position, not shown, in which the torso support section 12 and the head support section 14 jointly with the center support section 6 form one horizontal support plane, into an adjusted position as illustrated in FIG. 2, the electric motor 20 drives the spindle 24 via the gear transmission 22 in such fashion that the spindle nut 26 per FIG. 3 travels to the right. During that process the chain 42 meshes with the teeth of the gear-wheel segment 40 so that, as the spindle nut 26 per FIG. 3 is set in motion, the gear-wheel segment is tilted clockwise to the right around the swivel axis 34 as viewed in FIG. 3. Because of the rigid connection between the pivot lever 38 and the pivot shaft 36, the pivot lever in FIG. 3 as well is shifted in a clockwise direction, consequently tilting the torso support section 12 and the head support section 14 per FIG. 1 in a clockwise direction.

During the adjustment movement the chain 42 at point P is continuously engaged in the gear-wheel segment 40, as a result of which the effective length of the lever arm 44, through which the chain 42 engages in the pivot shaft 36, will not change during the adjustment movement. In turn, since the effective length of the lever arm 44 does not change during the adjustment movement, a constant driving torque of the electric motor 20 will keep the adjustment force that the furniture drive mechanism 18 can bring to bear on the torso support section 12 and the head support section 14 during the adjustment movement substantially unchanged. In other words, the furniture drive mechanism 18 according to this invention is capable of applying substantially constant forces on the torso support section 12 and the head support section 14 throughout the adjustment movement.

Figure 4:
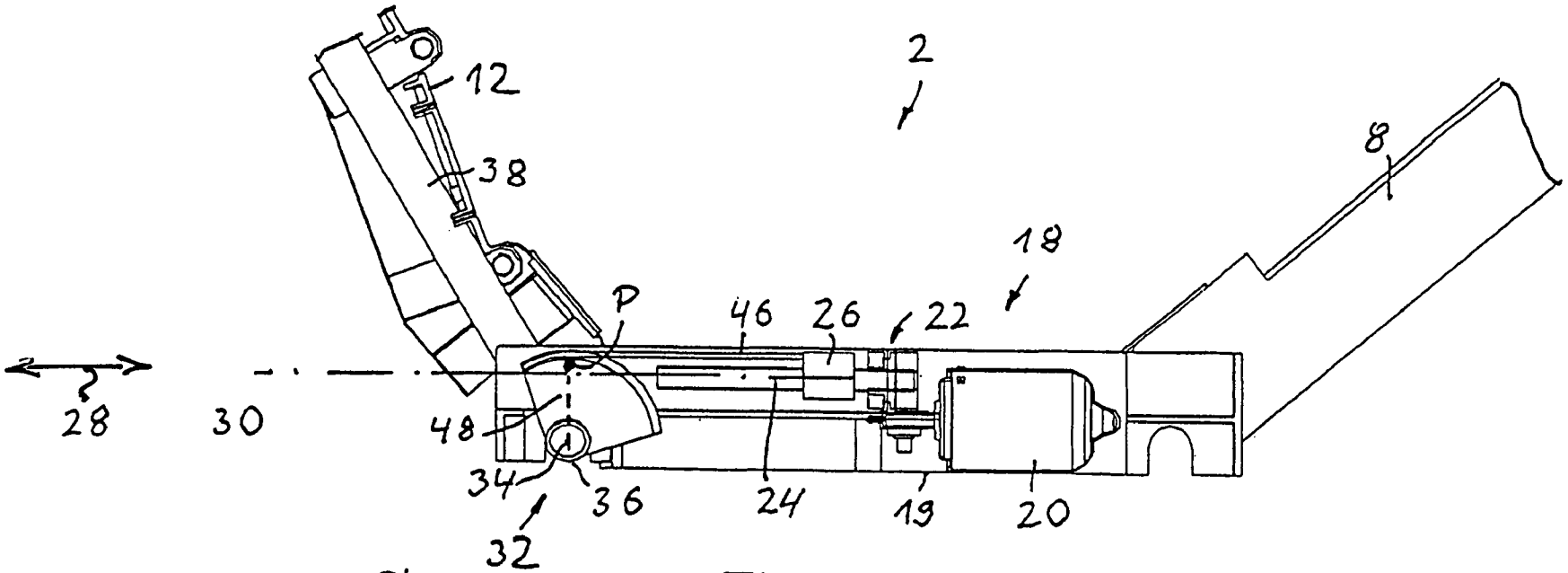
FIG. 4 in similar fashion as FIG. 3, shows another embodiment of a furniture drive mechanism according to the invention.

FIG. 4 depicts another embodiment of a furniture drive mechanism 18 according to this invention, which differs from the embodiment per FIG. 3 in that the drive unit employs a flexible belt 46 instead of a chain. In this embodiment, the swivel element that is rigidly connected to the pivot lever 38 and constitutes a cam-like guide element for the belt 46, is in the form of a belt pulley 48 that works along the principle of a rope reel. One end of the belt 46 is attached to the pulley 48 while its other end is attached to the spindle nut 26. During the adjustment movement in this embodiment, the belt 46 engages the pulley 48 at an substantially fixed point P along the linear axis of travel 30, so that the effective length of the lever arm 44 through which the belt 46 engages in the pivot shaft 36 remains substantially unchanged during the adjustment movement.

Figure 5:
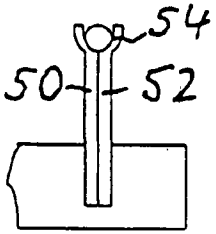
FIG. 5 on a scale larger than that of FIG. 4, is a view from the left of a belt pulley of the furniture drive mechanism per FIG. 4.

FIG. 5 shows that the pulley 48 of FIG. 4, viewed from the left, is composed of two mutually connected disks 44 whose ends facing away from the swivel axis 34 are bent outward so as to form a groove 54 that accepts the belt 46. Retaining the belt 46 in the groove 54 prevents the belt 46 from slipping off the pulley 48 during the adjustment movement.

Figure 6:
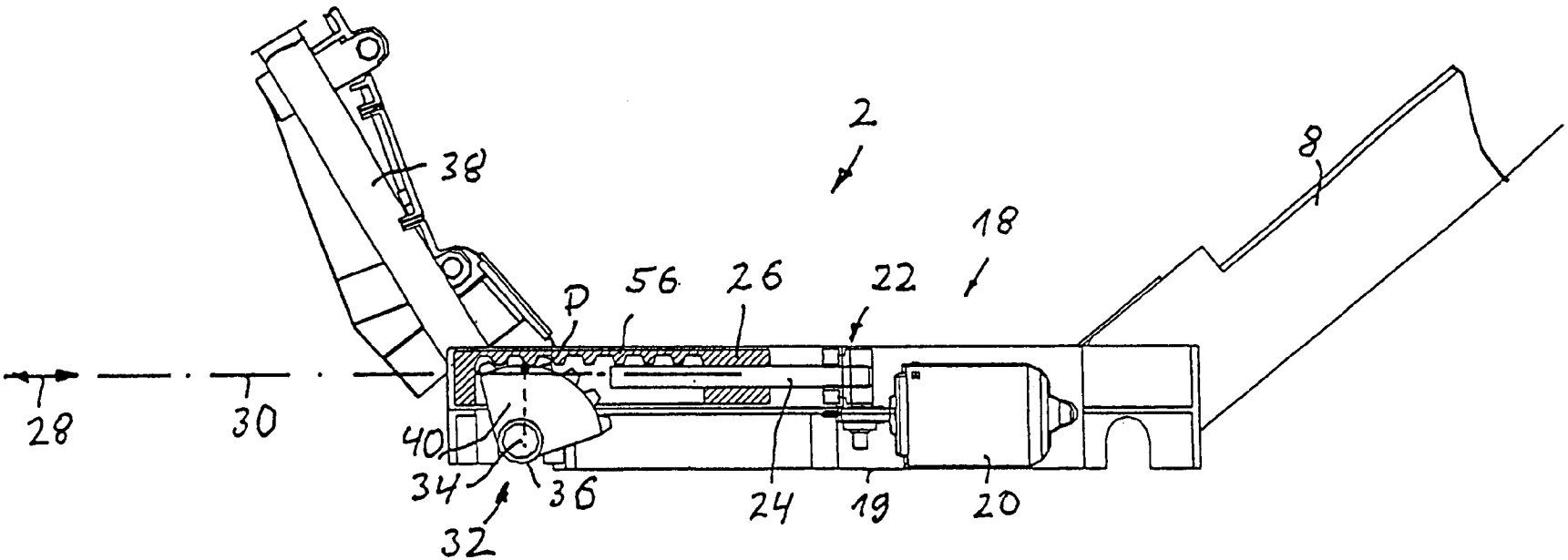
FIG. 6 is a view, similar to that in FIG. 3, of a further embodiment implementation of a furniture drive mechanism according to this invention.

FIG. 6 illustrates a third embodiment of a furniture drive mechanism 18 according to the invention, which differs from the embodiment per FIG. 3 in that the drive unit is provided with a toothed rack 56 in place of a chain 42, which rack is integrated into the end of the spindle nut 26 facing the gear-wheel segment 40. For example, the toothed rack 56 and the spindle nut 26 may include of a single integrated molding of a synthetic material. The teeth of the toothed rack 56 are so shaped as to substantially match and mesh with the teeth of the gear or gear-wheel segment. During the adjustment movement in this embodiment the toothed rack 56 remains engaged in the gear-wheel segment 40 at an substantially fixed point P of the linear axis of travel throughout the adjustment movement, so that the length of the lever arm through which the toothed rack 56 engages in the pivot shaft 36 will remain substantially unchanged.

The furniture drive mechanism 18 according to this invention is uncomplicated, it can be produced at low cost, and it is of a rugged design.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

The invention claimed is:

1. Electromechanically adjustable support system for the cushions of a piece of furniture of the type including a minimum of two mutually adjustable support sections, the adjustable support system, comprising:

a) an electromechanical furniture drive mechanism configured for adjusting the support sections relative to one another;

b) the furniture drive mechanism including a drive unit configured and disposed for being axially moved along a linear axis of travel for tilting a swivel unit, which is functionally connected to an adjustable section of the piece of furniture and can be rotated around a swivel axis;

c) the drive unit to remain engaged in the swivel unit at a substantially fixed point along the linear axis of travel throughout the adjustment movement;

d) a device being provided and configured for causing the drive unit to remain engaged in the swivel unit at the substantially fixed point along the linear axis of travel during the adjustment movement, the device including a cam for the drive unit, and the cam engaging in the drive unit;

e) the cam including a circumference, and the circumference of the cam tangentially engaging the linearly moving drive unit at the substantially fixed point along the linear axis of travel throughout the adjustment movement; and f) the swivel axis and the substantially fixed point define an effective length, and the effective length being substantially the same throughout the adjustment movement.

2. Support system as in claim 1, wherein:

a) the cam substantially has a limited circular-arc profile.

3. Support system as in claim 2, wherein:

a) the cam is substantially in the form of the segment of a circle.

4. Support system as in claim 1, wherein:

a) the cam has a substantially curved profile whereby, in the circumferential direction, at least parts of the cam vary in their distance between the periphery of the profile and the swivel axis.

5. Support system as in claim 1, wherein:

a) the drive unit is configured as a traction element.

6. Support system as in claim 5, wherein:

a) the drive unit is flexible.

7. Support system as in claim 6, wherein:

a) the drive unit is attached to one of the swivel unit and the cam.

8. Support system as in claim 1, wherein:

a) the drive unit is configured as a pressure element.

9. Support system as in claim 1, wherein:

a) the drive unit is substantially rigid.

10. Support system as in claim 1, wherein:

a) a surface of the drive unit that engages in the cam is toothed so as to mesh with the substantially matching teeth of the cam.

11. Support system as in claim 10, wherein:

a) the cam is in the form of one of a gear or a gearwheel segment.

12. Support system as in claim 11, wherein:

a) the drive unit includes at least one of a chain and a chain drive.

13. Support system as in claim 11, wherein:

a) the drive unit incorporates a toothed rack, thus constituting a rack-and pinion drive.

14. Support system as in claim 1, wherein:

a) the drive unit includes a belt drive.

15. Support system as in claim 1, wherein:

a) the cam is integrated in a one-piece configuration with the swivel unit.

16. Support system as in claim 1, wherein:

a) the axially movable drive unit includes a linearly movable drive element of a spindle drive.

17. Support system as in claim 16, wherein:

a) the axially movable drive element of the spindle drive includes a spindle nut positioned in rotationally locked, axially movable fashion on a rotarydrive spindle.

18. Support system as in claim 16, wherein:

a) the linearly movable drive element of the spindle drive includes an axially movable, rotationally locked spindle on which a stationary, rotationally drivable spindle nut is positioned.

19. Support system as in claim 1, wherein:

a) the cam includes one of a gear and a gear-wheel segment.

20. Support system as in claim 19, wherein:

a) the drive unit includes a toothed rack.

21. Support system as in claim 19, wherein:

a) the drive unit includes at least one of a chain and a chain drive.

22. Support system as in claim 1, wherein:

a) the drive unit includes a toothed rack.

23. Support system as in claim 1, wherein:

a) the drive unit includes at least one of a chain and a chain drive.

* * * * *